US008540076B2

(12) United States Patent
Bucholz

(10) Patent No.: US 8,540,076 B2
(45) Date of Patent: Sep. 24, 2013

(54) STACKABLE CONSTRUCTION CONTAINER

(76) Inventor: Gary Bucholz, Belmar, NJ (US)

( * ) Notice: Subject to any disclaimer, the term of this patent is extended or adjusted under 35 U.S.C. 154(b) by 74 days.

(21) Appl. No.: 13/317,578

(22) Filed: Oct. 24, 2011

(65) Prior Publication Data

US 2013/0098796 A1 Apr. 25, 2013

(51) Int. Cl.
*B65D 21/00* (2006.01)
*B65D 21/02* (2006.01)

(52) U.S. Cl.
USPC ..... 206/509; 206/349; 206/373; 206/499; 206/503; 206/504; 220/23.87; 220/23.88

(58) Field of Classification Search
USPC ..... 206/372, 373, 499, 503, 504, 509, 206/511; 220/23.2, 23.4, 23.6, 23.83, 23.87, 220/23.88, 23.89
See application file for complete search history.

(56) References Cited

U.S. PATENT DOCUMENTS 1,149,927 A * 8/1915 Lockwood ..... 220/23.2
2,127,967 A * 8/1938 Thomas ..... 312/281
3,362,576 A * 1/1968 Beesley et al. ..... 206/509
4,288,134 A * 9/1981 Knaack et al. ..... 312/290
4,303,158 A * 12/1981 Perkins ..... 206/373
5,709,008 A * 1/1998 Dickinson ..... 16/45
6,036,203 A * 3/2000 Tyus et al. ..... 280/47.26
6,041,931 A * 3/2000 Jacques ..... 206/505
6,250,490 B1 * 6/2001 Loftus ..... 220/23.4
6,454,121 B1 * 9/2002 Kurtz et al. ..... 220/573
7,731,308 B1 * 6/2010 Riemer ..... 312/209
D665,578 S * 8/2012 Bousquet ..... D3/276
2005/0103783 A1 * 5/2005 Bergum et al. ..... 220/23.86
2007/0080089 A1 * 4/2007 Anschutz ..... 206/509

* cited by examiner

*Primary Examiner* — J. Gregory Pickett
*Assistant Examiner* — Javier A Pagan
(74) *Attorney, Agent, or Firm* — Charles Brodsky

(57) ABSTRACT

Whether constructed of square or rectangular configuration with handles for lifting and carrying about, and with internal shelves or braces to receive and hold compartmentalized partitioned layers to accept the various tools of various trades, the container of the invention, when of a composition to support the weight of studs and boards placed upon them, provides a crate which cannot only carry the tools of the trade, but can serve as a workbench in performing needed work at a jobsite location, as well as to support the weight of a workman standing upon included boards and studs as a "step" to reach elevated heights in the doing of a required job.

9 Claims, 12 Drawing Sheets

STACKABLE CONSTRUCTION CONTAINER

CROSS-REFERENCE TO RELATED APPLICATIONS

NONE

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1. Field of the Invention

This invention relates to tool holding containers, and more particularly to tool carrying buckets or crates usable in the commercial or residential construction industries.

2. Description of the Related Art

Carpenters, electricians, plumbers and work crews in general, when employed on commercial construction jobs commonly bring their tools to the jobsite at the beginning of the workday, and then take them home with them when their shift ends. Rarely, if ever, do they leave their tools overnight for fear that the tools would not be there when they return the next day. Because these commercial construction workers employ many different tools in their jobs, and because several of the tools may be cumbersome to carry, such performance of their jobs often entails their having to make several trips each day back and forth to their trucks to get, and then return, those types of tools they need to complete the tasks at hand. This is both tedious to do and an undo waste of time.

OBJECTS OF THE PRESENT INVENTION

It is an object of the present invention, to provide a utility container for the easy transporting of such tools as are needed by carpenters, electricians, plumbers, and construction work crews, compartmentalizing and separating the tools one from another in so doing.

It is an object of the invention, also, to provide such a utility container as can be easily stackable one atop another for storage, and can be joined side by side and turned over for forming a step on which to stand in reaching raised places where a job at hand is to be performed, or for forming a type of workbench where construction tasks are to be carried out.

It is another object of the present invention to provide an overall single design for the utility container so that it can be used by each such craftsman simply by the inclusion of suitable compartments to fit each worker's own individual construction needs.

It is a further object of the invention to provide such a utility container design for use as well by an individual carpenter, electrician, or plumber working by himself/herself in residential construction where they might go from job-to-job during any given workday, instead of just returning to the same worksite to continue their project on following days.

It is yet a further object of the present invention to provide this utility container design for use by others besides carpenters, electricians and plumbers—such as those involved in arts and craft hobby and countless other usages where individualized compartmentalization and separation are advantageous in operation.

SUMMARY OF THE INVENTION

As will become clear from the following description, the stackable utility container of the invention incorporates a preferably squared or rectangular crate with handles for lifting and carrying the crate about, with internal shelves or braces to receive and hold template configured layer inclusions to accept the various tools of the work trade, and of a composition to support the weight of studs and boards placed upon them in forming workbench substitutes as a replacement for costly sawhorses, and to support the weight of a workman standing upon them as "steps" to reach elevated heights to do a job.

As will also be seen, such utility containers for use by carpenters, electricians and plumbers are preferably color-coded so that individual members of a work-crew can easily identify that container called for by the crew chief in the then doing of any work-in-progress task.

BRIEF DESCRIPTION OF THE DRAWINGS

These and other features of the invention will be more clearly understood from a consideration of the following description, taken in connection with the accompanying drawings, in which.

DETAILED DESCRIPTION OF THE INVENTION

While the teachings of the invention apply equally as well to utility crates and containers that are formed of a rectangular or square configuration, the following description specifically relates to a preferred version, of a "square-shaped" container. The apertures, their locations and their wing extensions will be understood to be at the corresponding location on the "rectangular-shaped" container although not shown as such.

Figure 1A:
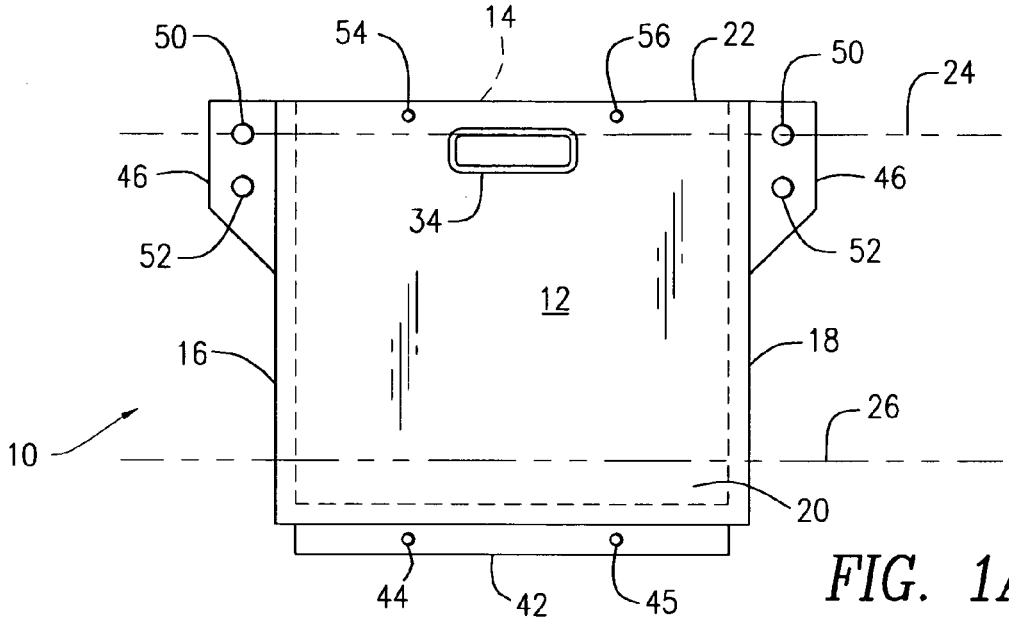
FIG. 1 is an illustration of a front view of the stackable container of the invention, with a pair of layer inserts as might be employed in the construction of a carpenter's crate.

Thus, in FIG. 1A, a front view of a carpenter's crate or container 10 is shown as including first and second opposing surfaces 12 and 14 (front and back), a pair of opposing side surfaces 16 and 18, a supporting bottom 20 and an open top 22. Such a crate, like the other's shown in the following description, may each be composed of a heavy duty plastic fabrication, and of color indicia coding as one being "red", as one being "blue", as one being "green", and as one being "yellow", for example. This is to differentiate one from another as far as their utilization as a carpenter's crate, an electrician's crate, a plumber's crate and a multipurpose utility crate is concerned, as the case and needs may be. Each crate and container is preferably of a heavy duty plastic fabrication.

A first compartmentalized partitioned layer 24 is shown in FIG. 1A extending inwardly of the container between its first and second opposing surfaces 12 and 14, and between its third and fourth opposing surfaces 16, 18 adjacent the open top 22. A second such layer 26 is likewise included between the first and second opposing surfaces 12 and 14, and between the third and fourth surfaces 16, 18, adjacent its supporting bottom 20. As shown in the FIG. 1B top view of the layer 24, a plurality of apertures 30 and 32 are included for the insertion of various tools as might be employed by a carpenter, with the FIG. 1C top view of the layer 26 in FIG. 1C, showing a punch-out 35 for a sawzall tool commonly employed by most carpenters. Although only a single handle section 34 is shown in the FIG. 1A front view (and on the surface 12), it will be understood that a similar such handle is included at the opposing surface 14 of the crate as a back view of the carpenter's crate 10 is just a mirror image of the front view of FIG. 1A. A series of braces or shelf supports 36 are shown at constructed on the inside of the container on its four opposing surfaces, to support the layer section 24 and the layer section 26. Each of the layers 24 and 26 may be installed as inserts within the crate or container, and of a predetermined compartmentalized construction to receive the tools of the trade, the compartments being illustrated, for example, at 38, 40. The handles 34 may be in the form of cut-outs for easy hand grasping in moving the carpenter's crate about.

In accordance with the invention, furthermore, a substrate base 42 is included, provided beneath the supporting bottom 20, and of a same configuration as the bottom 20, but of lesser cross-sectional area. Within the substrate base of FIG. 1A are a pair of spaced apertures 44, 45 which will also be understood as being included on the three other surfaces of the substrate base, again being spaced apart on each side. Lastly, a pair of wing sections 46 are included on the crate or container 10, individually extending along the lengths of the third and fourth opposing surfaces 16, 18 running from front to back. Each of the wing sections 46 also include a pair of spaced apertures 50, 52 on each side, and another such pair is included adjacent the open top of the container, as at 54, 56.

Figure 2A:
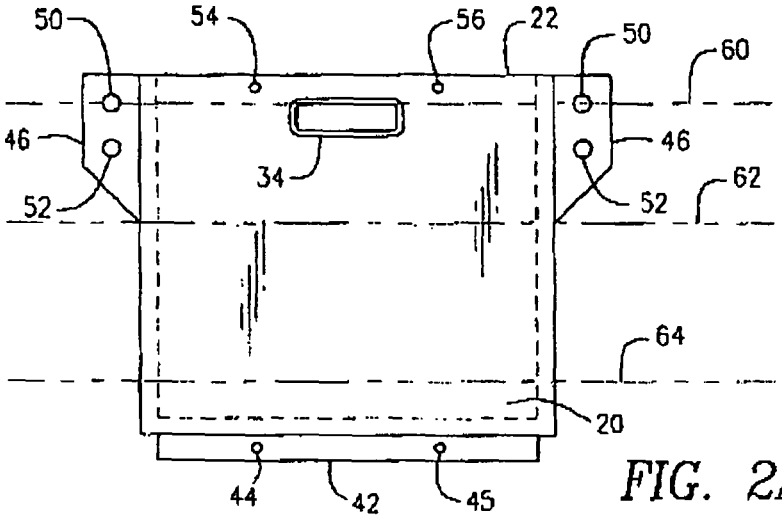
FIG. 2 is an illustration of a front view of the stackable container of the invention, with three layer inserts as might be employed in the construction of an electrician's crate.
Figure 2B:
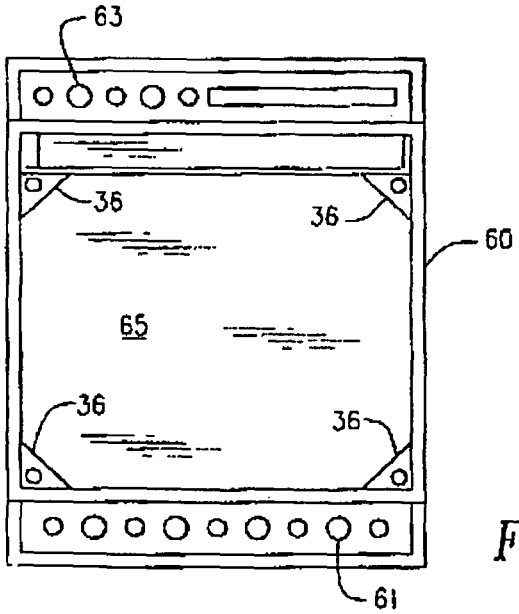
Figure 2C:
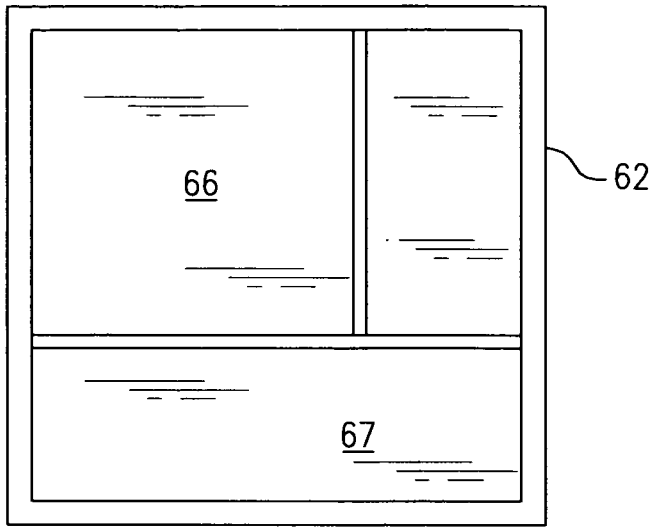
Figure 2D:
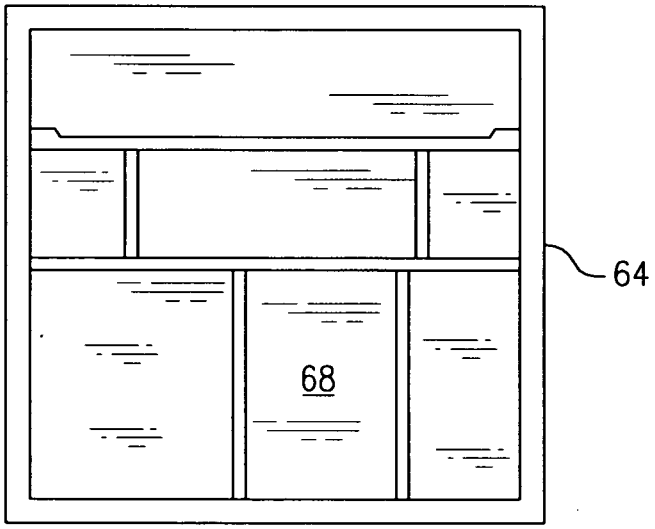

The front view of the electrician's crate of the invention shown in FIG. 2A is of corresponding construction as that of the front view of the carpenter's crate of FIG. 1A, but with a different configuration of layers inwardly extending between the four surfaces of the crate. In FIGS. 2B, 2C and 2D, three such layers are shown as 60, 62, 64, with their own compartments as 61, 63, 65, 66, 67, 68, etc., to receive, once again, the tools and accessories usually employed by an electrician in his/her work. The same wing section 46 is shown as in FIG. 1A, along with the same substrate base 42. The same arrangement of spaced apertures 44, 45 and 54, 56 as in FIG. 1A are shown in FIG. 2A—understanding that the substrate apertures 44, 45 would be included on all sides of the substrate base 42 as in the electrician's crate. The wing section apertures 50, 52 are also replicated in the front view of FIG. 2A, a rear view of the electrician's crate of FIG. 2A again being a mirror image of its front view. Similarly, a side view of the electrician's crate would appear the same as for the carpenter's crate.

Figure 1B:
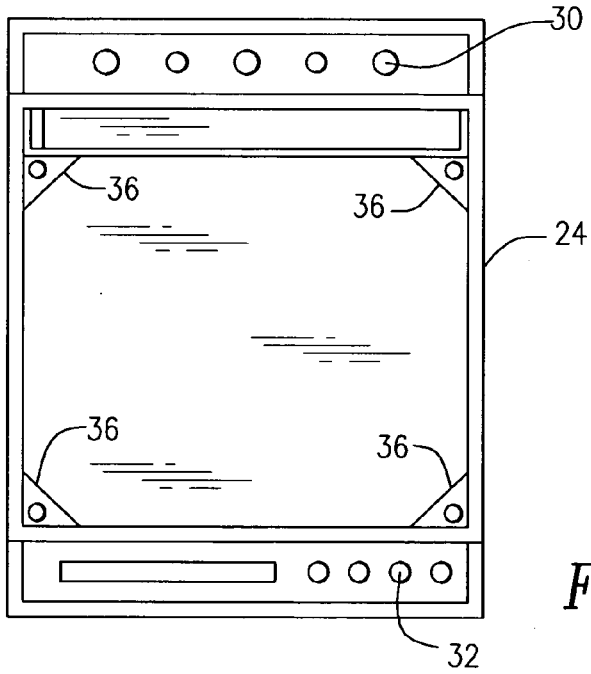
Figure 1C:
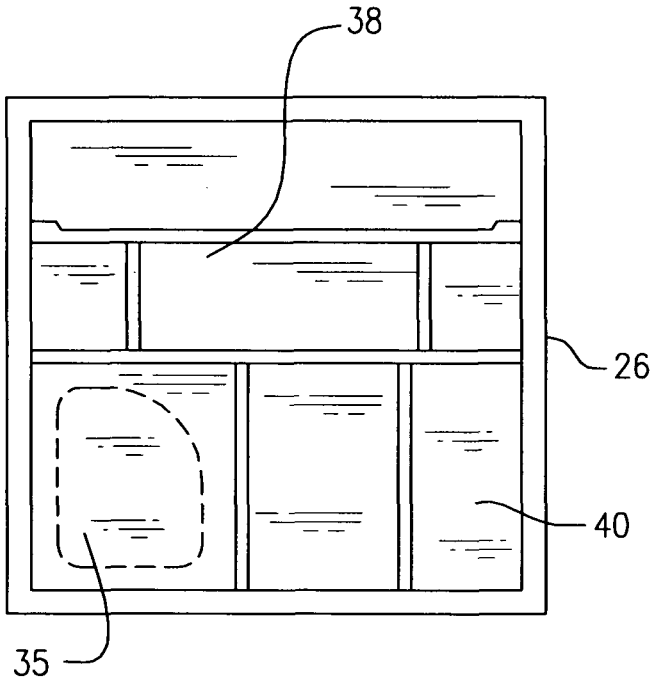
Figure 3A:
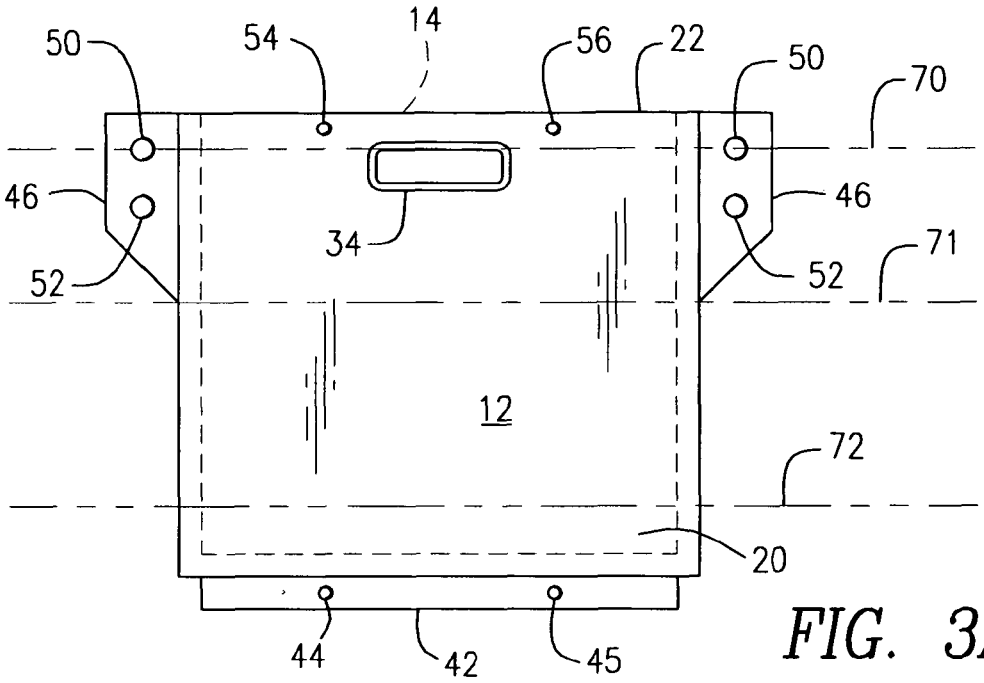
FIG. 3 is an illustration of a front view of the stackable container of the invention, with three layer inserts as might be employed in the construction of a plumber's crate.
Figure 3B:
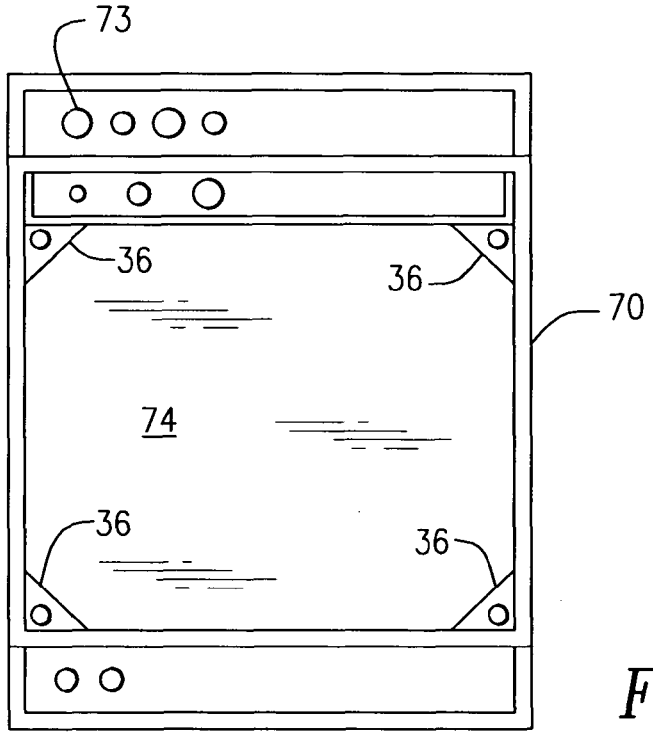
Figure 3C:
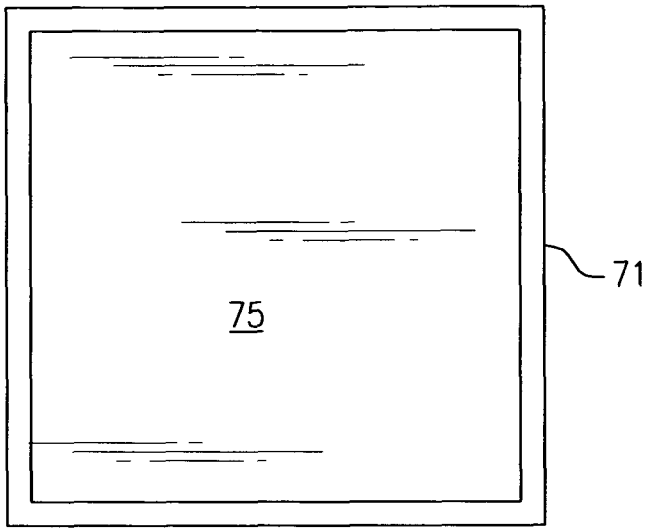
Figure 3D:
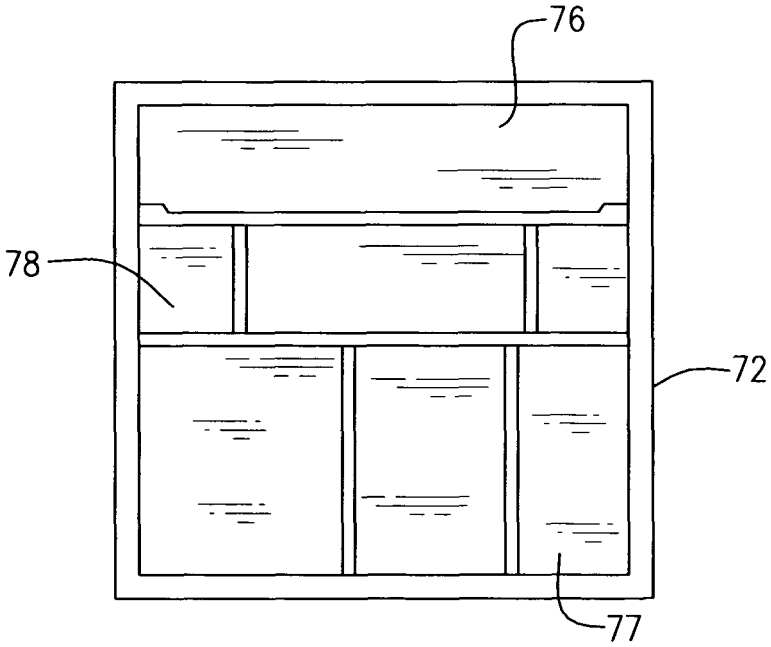

With this in mind, the front view of the plumber's crate of FIG. 3A would be a repeat of the corresponding views of FIGS. 1A and 2A—but, again, with its own set of layers 70, 71, and 72 as supported by the sleeves or braces 36 of FIGS. 1B and 23—illustrated as FIGS. 3B, 3C and 3D. A different set of apertures for receiving needed tools is shown at 73, with the individual compartments being shown for example at 74, 75, 76, 77, 78.

Figure 4A:
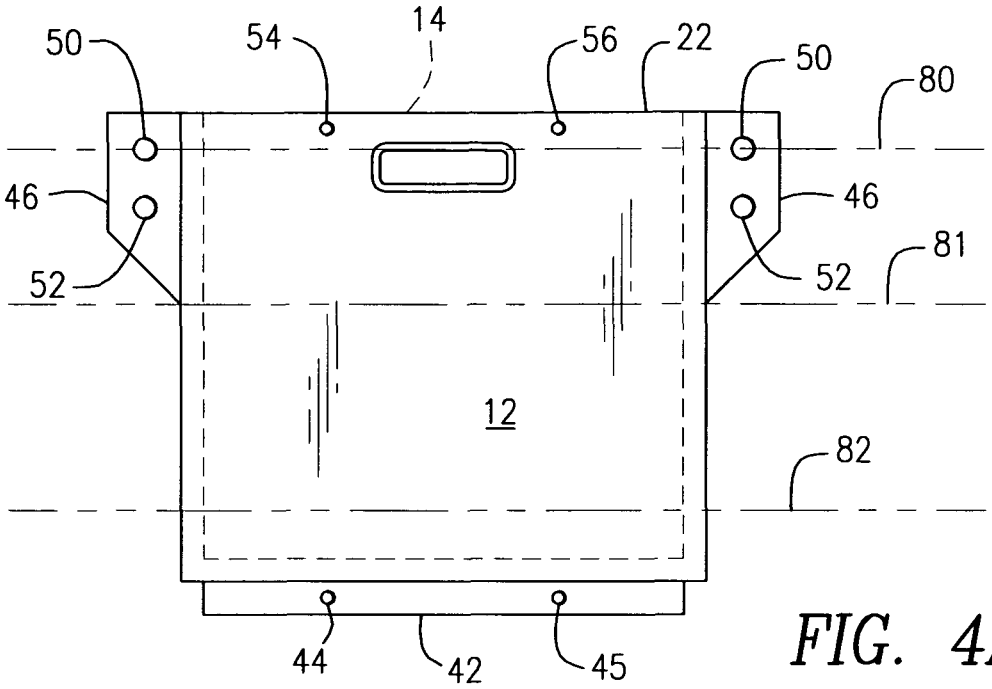
FIG. 4 is an illustration of a front view of the stackable container of the invention, with three layer inserts as might be employed in the construction of a multipurpose utility crate.
Figure 4B:
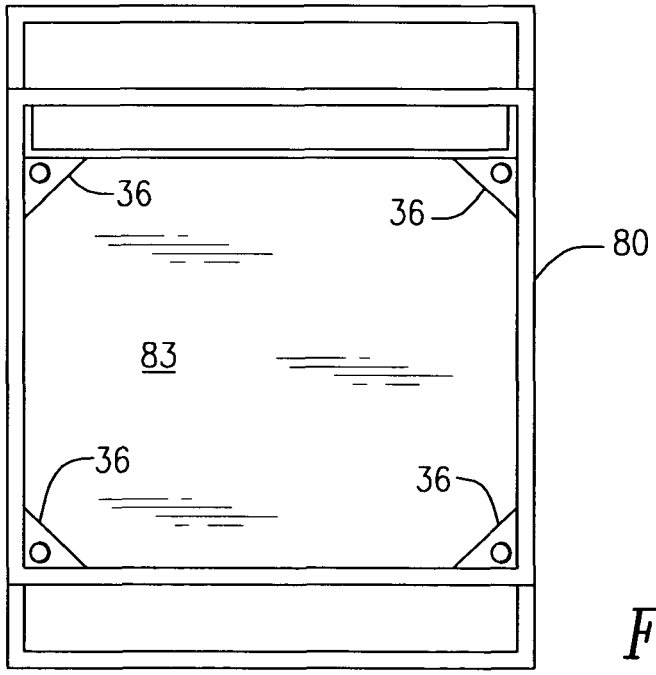
Figure 4C:
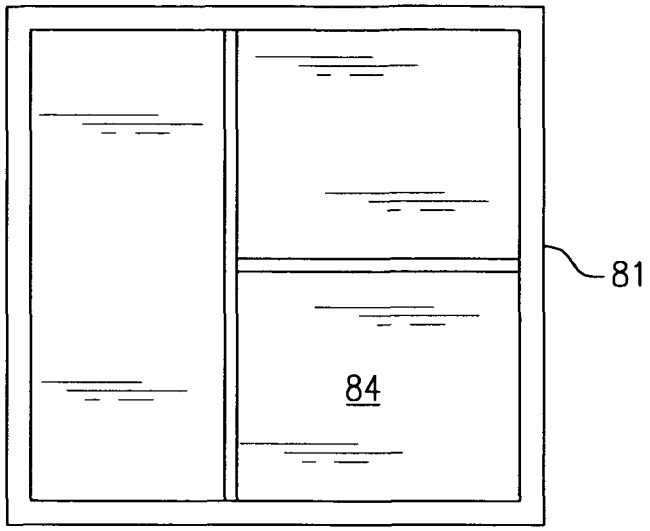
Figure 4D:
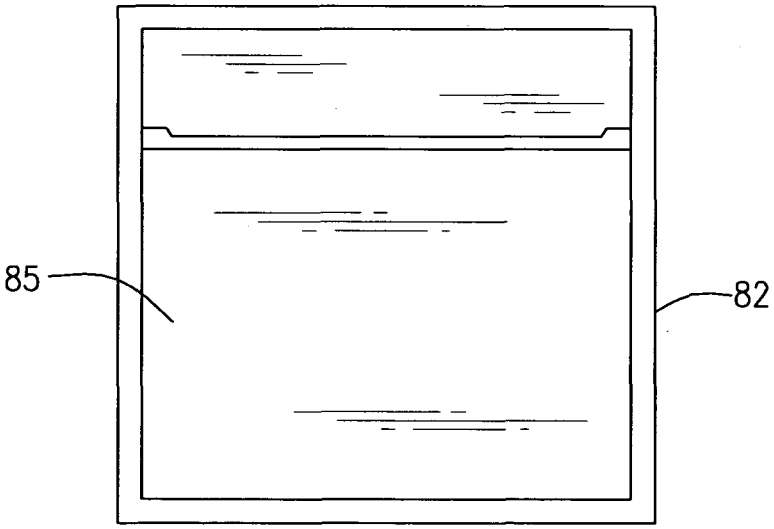

Likewise, with FIG. 4A, a view corresponding to that of FIG. 1A is shown, for a multipurpose crate container, the only difference essentially being that the multipurpose utility crate of FIG. 4 is shown with three layer inserts 80, 81, 82 inwardly extending on shelves or braces between the four opposing sides while that of FIG. 1 shows a two layer insert version container. Again, the open-top apertures 54, 56 are shown in FIG. 4A, as are the apertures 44, 45 of the substrate 42 base, on both its first and second opposing surfaces 12, 14. The layers of the multipurpose utility crate present their own set of compartments 83, 84, 85 etc., and their corresponding wing-section apertures 50, 52.

Figure 5:
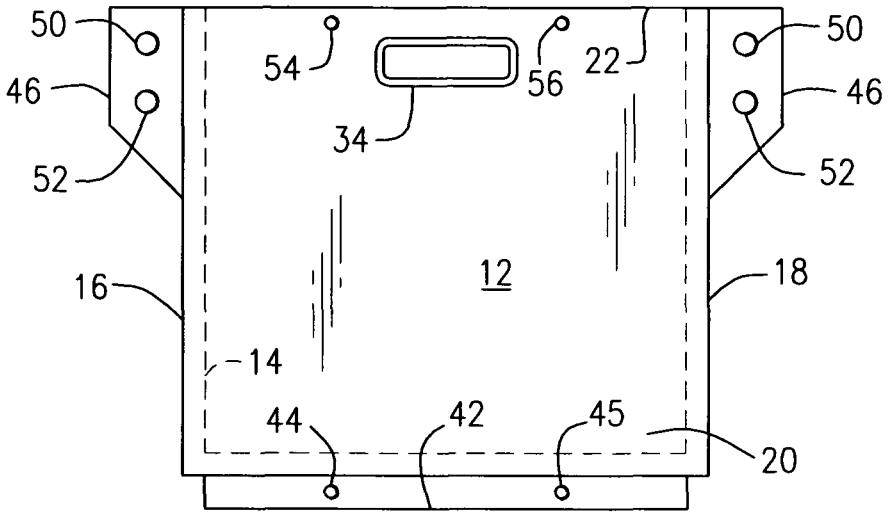
FIGS. 5, 6 and 7 are front, side and top views, respectively of a utility crate embodying the invention helpful in an understanding as to how one such crate may be fitted and stacked within another for purposes of storage or in forming, either by themselves or with other stackable containers "steps" to work at higher elevations at a construction site, or arranged in forming a work-type bench.
Figure 6:
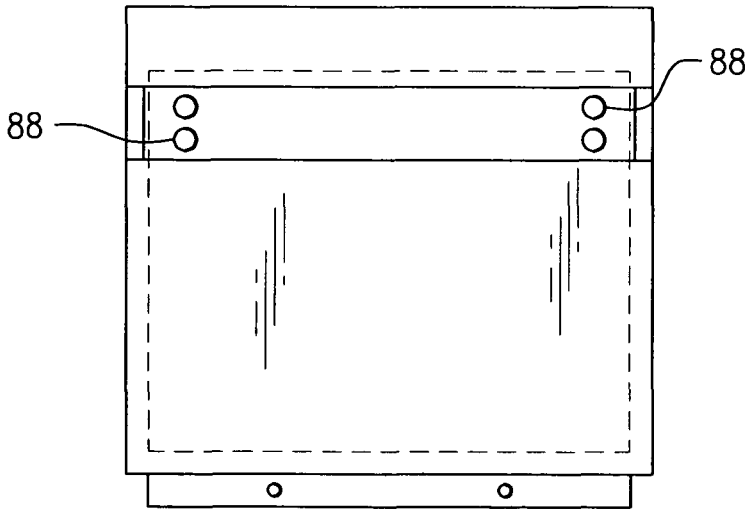
Figure 7:
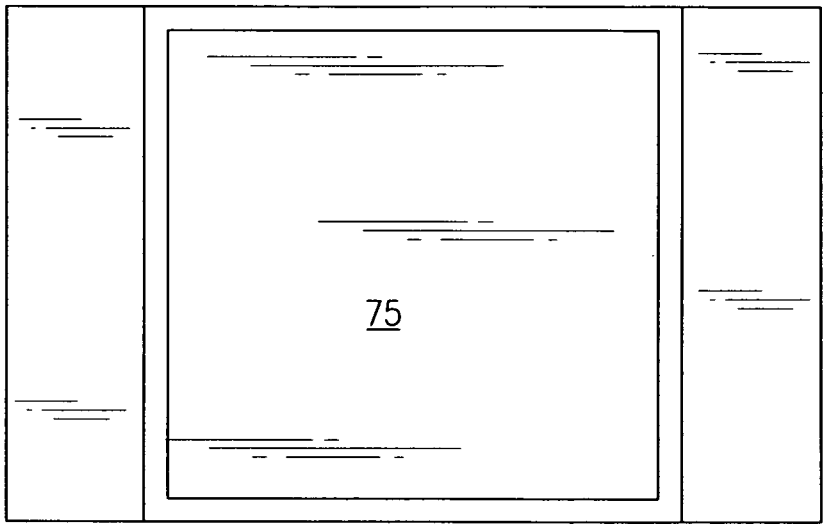

FIGS. 5, 6 and 7 are front, right side and top views of the container or crate of the invention. With a left side view of the container being a mirror image of the right side view, one or more additional apertures 88 are illustrated within the wing sections 46 to facilitate a side-by-side stacking of the containers (as described below with respect to FIG. 9) through the use of appropriate locking mechanisms.

Figure 8:
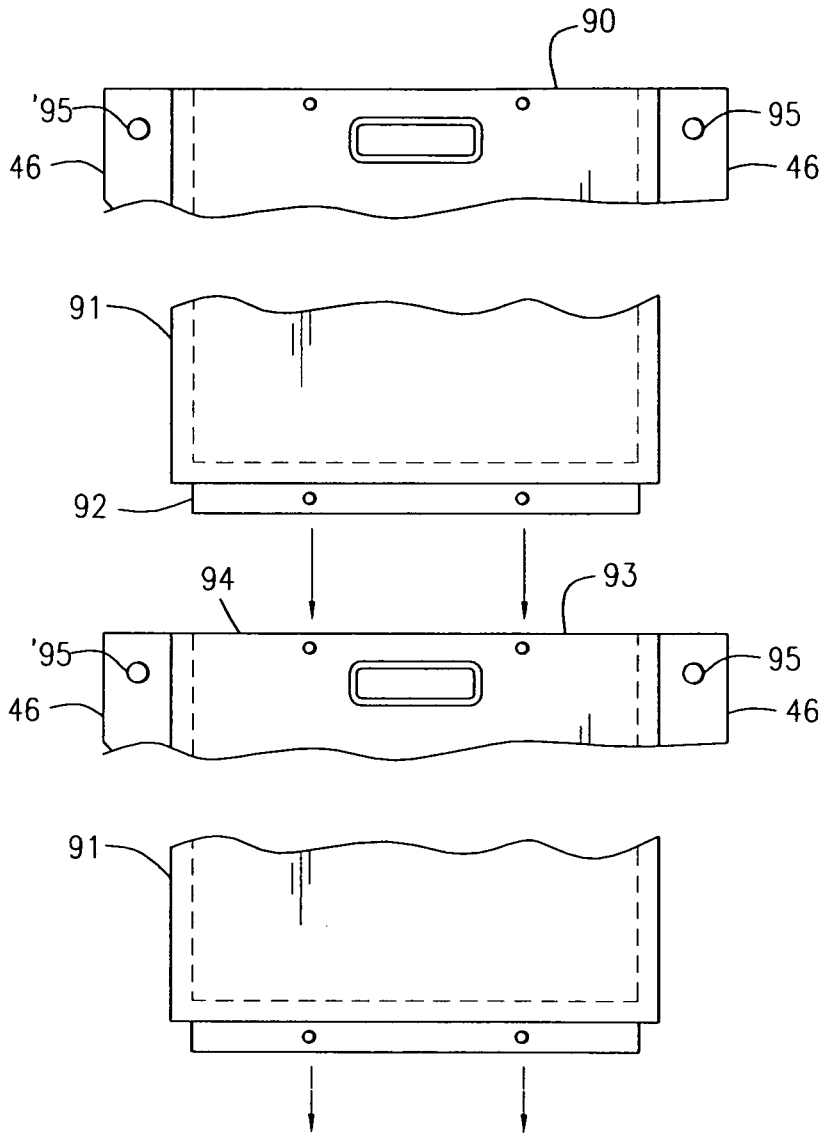
FIG. 8 is a pictorial view helpful in understanding the stacking of the utility crate of the invention.

FIG. 8 is helpful in an understanding as to how one crate of the invention may be fitted into a second for stacking purposes. That is, a top crate 90 fits into a bottom crate 91, by the substrate base 92 of the top one being of a comparable configuration as, but of a lesser cross-section, than the open top 93 of the lower crate 91. As the spaced apertures 44, 45 in the substrate 42 of the top crate is made to align vertically with the apertures 54, 56 in the lower crate, the one crate fits inside the other crate, and the two can be secured by locking pins, bolts or screws through the apertures, as shown at 94. Such stacking of crates allows for the easy storage of them. In the rear of a pickup truck for example, they can be made to join up with a like pair on an opposite side of the truck bed so that various picks, shovels, and other larger tools can be temporarily housed beneath a piece of plywood placed upon the stacks to be protected from rain or snow. As FIG. 8 illustrates, wing sections can be employed having only a single aperture 95, instead of spaced apertures 50, 52 one above the other, as in FIGS. 1A, 2A, 3A, 4A and 5A.

Figure 9:
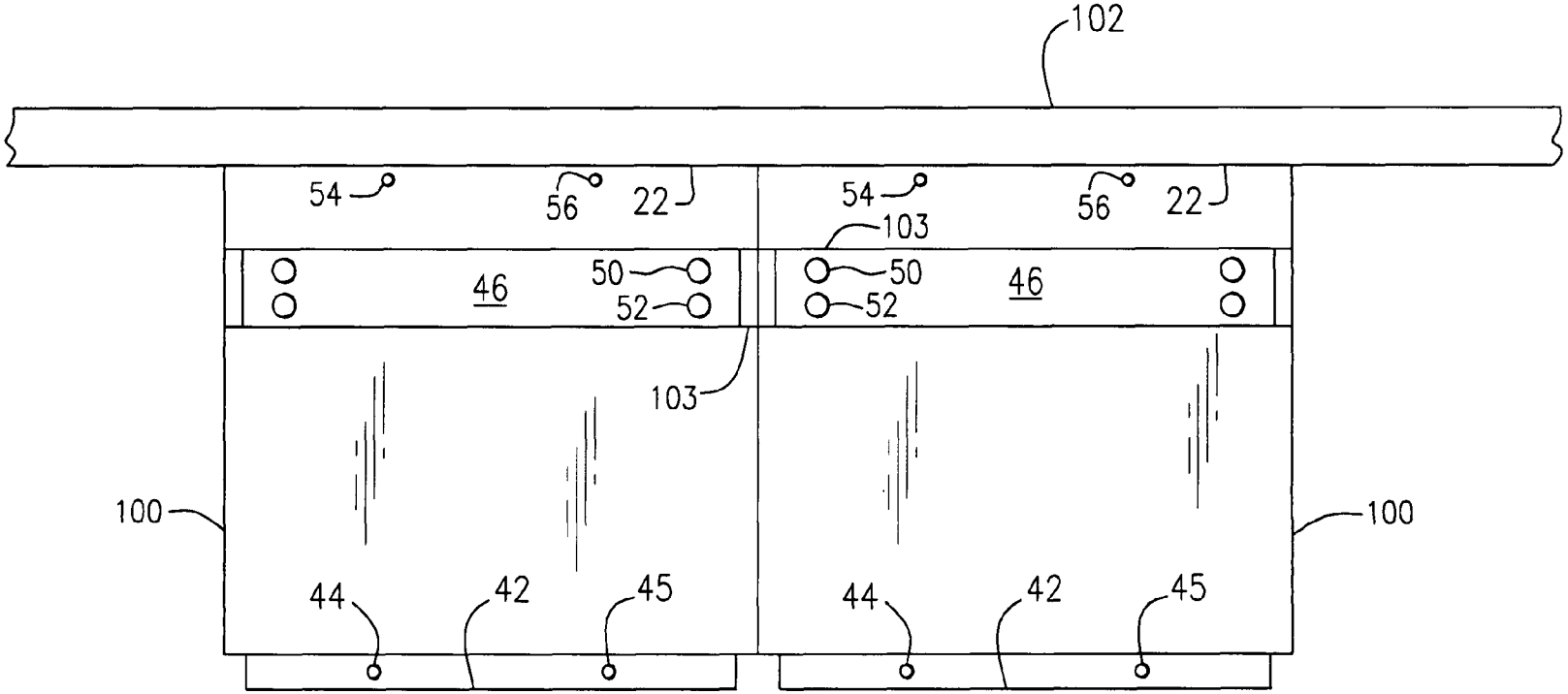
FIG. 9 is a pictorial view helpful in understanding a side-by-side alignment of the utility crates in forming a workbench.

FIG. 9, on the other hand, shows a configuration where two such containers could be laid side by side, or 2 stackings of containers 100 side-by-side, with a length of wood or other material 102 over them in forming a workbench. The wing sections 46 are arranged with a closed bottom and an open top to receive, for example, a length of 2×4" in extending above the open top 22 of the crate or container. The length of wood rests on the 2×4's, while appropriate locking pins, bolts or screws are inserted through the facing apertures to join the two crates together, as at 103. And, with appropriate thicknesses selected for the overlying material 100, this side-by-side construction of the crates of the invention could itself serve as a type of step to reach higher areas of work without having to stack one crate upon the other, as in the view of FIG. 8.

And, as previously mentioned, a construction crew chief could just advise a member of his crew as to what type of crate is required for a job—just by asking for the "blue" crate, the "red" crate, the "green" crate, or the "yellow" crate, each of which is identified for use for a carpenter, an electrician, or a plumber.

While there have been described what are considered to be preferred embodiments of the present invention, it will be readily appreciated by those skilled in the art that modifications can be made without departing from the scope of the teachings herein—such as for usages other than as previously set out. For at least such reason, therefore, resort should be had to the claims appended hereto for a true understanding of the scope of the invention.

I claim:

1. A stackable container comprising:

first and second opposing surfaces, third and fourth opposing surfaces, a supporting bottom and an open top;

first and second wing sections open at a too end and closed at a bottom and, individually extending outwardly from said first and second opposing surfaces respectively;

first and second handle sections individually at said third and fourth opposing surfaces respectively;

a substrate base coupled with and beneath said supporting bottom;

with said substrate base being of substantially the same configuration as said open top but of a lesser cross-sectional area thereof;

with at least one aperture in each of said third and fourth opposing surfaces adjacent a top thereof;

with at least one aperture in said substrate base being in vertical alignment with at least one of said apertures in each of said third and fourth opposing surfaces;

a first compartmentalized partition layer of predetermined construction extending inwardly of said container between said first and second opposing surfaces, and a second compartmentalized partition layer of predetermined construction extending inwardly of said container between said third and fourth opposing surfaces, with said first layer being adjacent to said supporting bottom and with said second layer being adjacent to said open top;

wherein each of said first and second layers are compartmentalized for receipt of construction tools utilized by individual ones of carpenters, electricians, plumbers, and general handymen;

individual ones of shelves and braces extending inwardly from said first and second opposing surfaces and from said third and fourth opposing surfaces for supporting said first and second compartmentalized partition layers;

wherein each of said first and second wing sections include at least one aperture at left and right opposing ends thereof, sized to receive individual ones of bolts, screws and pins extending through each of said apertures of said substrate base and each of said apertures of said third and fourth opposing surfaces to secure a pair of stackable containers one inside the other.

2. The stackable container of claim 1 wherein each of said third and fourth opposing surfaces includes two spaced apertures, wherein said substrate base includes two spaced apertures, and wherein each of said substrate base apertures are in vertical alignment with individual ones of said two spaced apertures of said third and fourth opposing surfaces.

3. The stackable container of claim 1 wherein each of said first and second handle sections include cut-outs within such third and fourth opposing surfaces for the lifting and carrying about of said stackable container.

4. The stackable container of claim 1 wherein each of said first and second wing sections individually extend horizontally along the lengths of said first and second opposing surfaces.

5. The stackable container of claim 1 wherein each wing section is of width to receive a 2"×4" wall stud resting on its closed bottom and extending above its open top.

6. The stackable container of claim 1 wherein said first and second opposing surfaces, said third and fourth opposing surfaces and said supporting bottom are of a color indicia coding.

7. The stackable container of claim 1 wherein said first and second opposing surfaces, said third and fourth opposing surfaces and said supporting bottom are of a heavy duty plastic fabrication.

8. The stackable container of claim 1 wherein each of said first and second wing sections also include at least one further aperture sized to receive individual ones of bolts, screws and pins extending through said further aperture to secure a pair of stackable containers side-by-side.

9. The stackable container of claim 1 wherein said first and second opposing surfaces, said third and fourth opposing surfaces, said supporting bottom and said open top form a container of one of square and rectangular configuration.

* * * * *